United States Patent [19]

Hall et al.

[11] Patent Number: 4,636,602

[45] Date of Patent: Jan. 13, 1987

[54] LINEAR OPERATING MECHANISM FOR ELECTRICAL SWITCHES

[75] Inventors: Walter J. Hall, Evanston; Chester H. Lin, Skokie; Joel A. Ramos, Chicago; Edward J. Rogers, Chicago, all of Ill.

[73] Assignee: S&C Electric Company, Chicago, Ill.

[21] Appl. No.: 721,617

[22] Filed: Apr. 10, 1985

[51] Int. Cl.[4] ..... H01H 3/00

[52] U.S. Cl. ..... 200/153 SC; 200/318; 74/2

[58] Field of Search ..... 200/153 SC, 153 W, 318, 200/320, 323-325, 61.62, 61.53; 74/2; 185/37, 39; 251/66, 74, 89, 111, 114, 263

[56] References Cited

U.S. PATENT DOCUMENTS

| | | | |
|---|---|---|---|
| 1,176,008 | 3/1916 | Webster | 185/37 |
| 2,778,450 | 1/1957 | Debuit | 185/37 |
| 2,913,906 | 11/1959 | Sinclair | 74/2 |
| 3,600,541 | 11/1971 | Goodwin | 200/153 |
| 3,728,508 | 4/1973 | Netzel | 200/153 |
| 3,784,764 | 1/1974 | Wilson | 200/50 |
| 3,811,022 | 5/1974 | Guidosh | 200/153 SC |
| 3,835,277 | 9/1974 | Skreiner | 200/318 |
| 3,845,263 | 10/1974 | Dickinson | 200/153 |
| 3,876,847 | 4/1975 | Dykes et al. | 200/153 |
| 3,898,409 | 8/1975 | Liebig et al. | 200/153 |
| 3,913,459 | 10/1975 | Skreiner | 92/23 |
| 4,105,878 | 8/1978 | Date et al. | 200/146 |
| 4,121,077 | 10/1978 | Mrenna et al. | 200/308 |
| 4,124,790 | 11/1978 | Kumbera et al. | 200/144 |
| 4,162,385 | 7/1979 | Bould et al. | 200/153 SC |
| 4,361,167 | 11/1982 | Harasewych | 251/74 |
| 4,453,056 | 6/1984 | Liebig | 200/153 |
| 4,646,292 | 2/1972 | Barkan et al. | 200/82 |

FOREIGN PATENT DOCUMENTS

| | | | |
|---|---|---|---|
| 402543 | 7/1966 | Australia | 200/153 SC |

*Primary Examiner*—Stephen Marcus
*Assistant Examiner*—Linda J. Sholl
*Attorney, Agent, or Firm*—James V. Lapacek

[57] ABSTRACT

A linear operating mechanism is provided for operating one or more electrical switches or interrupters, the mechanism selectively closing the switch via movement of a switch operating member and immediately thereafter being capable of opening the switch as required. The operating mechanism includes a carriage that is movable over a linear path to charge an opening spring and a closing spring. The switch operating member is movable along an axis parallel to or coincident with the path of the carriage. The opening spring and the closing springs are disposed about a common axis parallel to the movement of the carriage and the switch operating member. A first latch arrangement is provided for preventing switch-closing movement of the switch operating member when the switch is open and the first latch arrangement is engaged. A second latch arrangement is provided for preventing movement of the carriage opposite to the direction of charging movement after the springs are charged and when the second latch arrangement is engaged. The latch arrangements each include a gapped, latch ring that cooperates with a latch member that is received within the gap of the latch ring. The carriage and the switch operating member each carry one of the latch rings. The latch members are slidable and pivotal with respect to the plane of the latch rings to accomplish latching and trip release movement. When it is desired to close the switch, the switch operating member is released and the closing spring drives the switch operating member to close the switch. Thereafter, when it is desired to open the switch, the carriage is released and is driven by the opening spring to move the switch operating member to open the switch. Orientation control arrangements are provided to control the orientation of the carriage and the switch operating member with respect to the latch member and to control orientation of each latch ring with respect to the carriage or the switch operating member which carries the respective latch ring.

56 Claims, 16 Drawing Figures

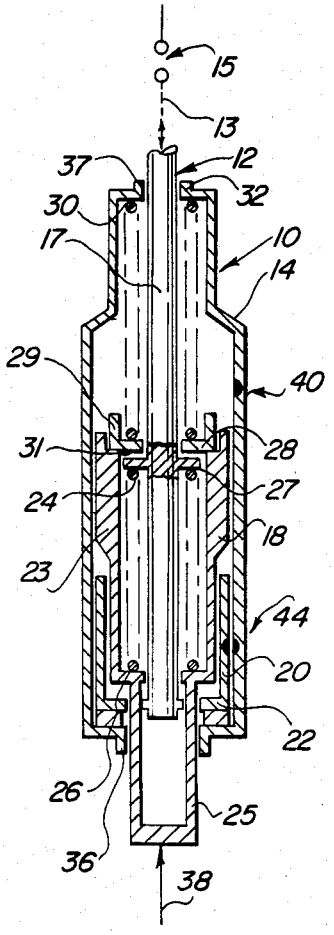
FIG. 1
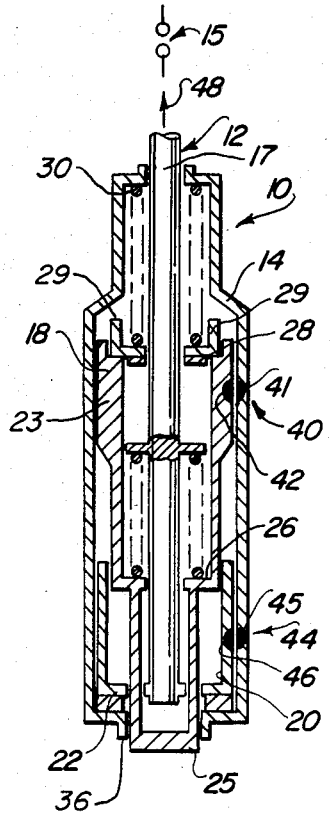
FIG. 2
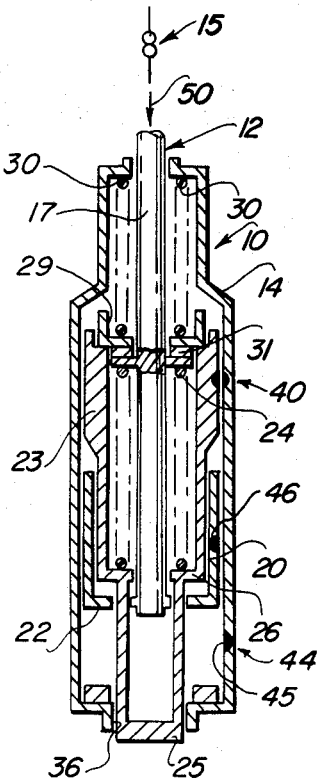
FIG. 3
FIG. 5
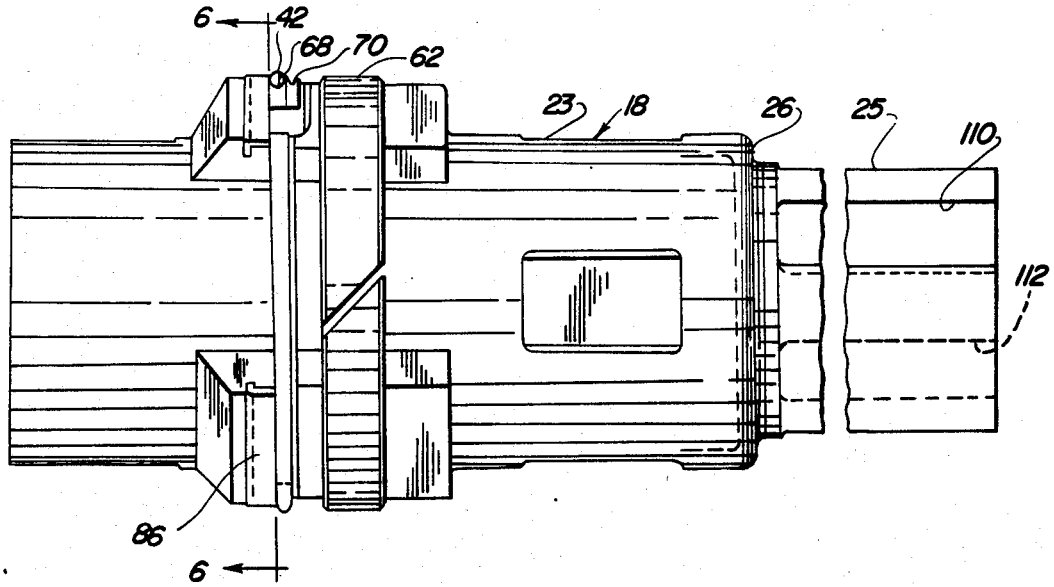

200
212
215
217
219
224
224A
225
227
229
230
240
241
242
244
245
246
248
250
214
218
220
238
260

LINEAR OPERATING MECHANISM FOR ELECTRICAL SWITCHES

CROSS-REFERENCE TO RELATED APPLICATIONS

This application is directed to a linear operating mechanism of the basic type disclosed and claimed in commonly-assigned, co-pending application Ser. No. 721,613 filed in the name of Chester H. Lin on Apr. 10, 1985, and now U.S. Pat. No. 4,578,551.

BACKGROUND OF THE INVENTION

1. Field of the Invention

The present invention relates generally to the field of operating mechanisms for electrical switches and more particularly to an improved linear operating mechanism that operates in accordance with the basic principles disclosed in the aforementioned, commonly-assigned, copending application Ser. No. 721,613.

2. Description of the Related Art

Various operating mechanisms are utilized to operate switches and the like between open and closed positions. In particular, operating mechanisms are desirable for switch applications that store operating energy to selectively close a switch and to immediately thereafter be capable of opening the switch as required.

A first variety of operating mechanism provides for the charging of an opening spring during the switch closing operation. Examples of this type of mechanism are disclosed in the following U.S. Pat. Nos. 4,453,056; 4,121,077; 4,105,878; 3,898,409; 3,845,263; 3,835,277; 3,784,764; 3,728,508 and 3,600,541. This type of operating mechanism requires a higher-capacity closing spring to perform the functions of both closing the switch and charging the opening spring. The requirement of a higher-capacity closing spring is, of course, undesirable since it also requires higher-capacity latching, driving, and supporting arrangements, as well as high speed latch engagement for the opening components.

Another variety of operating mechansim requires the detaching of the closing spring from the operating member during switch opening. This type of operating mechanism requires a relatively complex arrangement for the required detaching of the closing spring. U.S. Pat. No. 3,876,847 discloses an arrangement that sequentially charges the closing spring and then the opening spring; the arrangement also including the detaching of the closing spring during switch opening.

An operating mechanism that avoids some of the drawbacks of the aforementioned approaches is disclosed in U.S. Pat. No. 4,124,790. The arrangement as seen in FIGS. 5 and 8 of that patent includes a closing spring 75 connected between a drive lever assembly 70 and the frame, and an opening spring 76 connected between the drive lever assembly 70 and a switch operating lever assembly 69. The springs 75 and 76 are charged by movement of the drive lever assembly 70. A separately biased, toggle lever assembly 71 acts between a pivotal lever arm 77 of the switch operating assembly 69 and a pivotal lever arm 123 of the drive lever assembly 70. The pivotal lever arm 77 is connected through linkage 72 to operate a switch. When the springs are charged, the drive lever arm 123 is latched by a plate 147. The toggle lever assembly 71 is latched by means of a latch that is operative to maintain the pivotal toggle arms 95 and 97 of the assembly 71 in the latched position. The lever arm 77 is held in position by the latched, toggle arms 95,97 acting against the latched drive lever arm 123. To close the switch, the drive lever arm 123 is unlatched, whereupon the closing spring 76 pivots the arm 123 counterclockwise with the lever arm 77 being correspondingly pivoted counterclockwise through toggle arms 95,97. The pivoting of the lever arm 77 closes the switch. To open the switch, the latch on the toggle arms 95,97 is released. As the toggle arms 95,97 collapse, the opening spring 76 pivots the lever arm 77 in the clockwise direction. This configuration is complex and is neither suitable nor desirable for many applications. For example, the switch operating drive lever assembly 69 is only indirectly latched through the collapsable toggle lever assembly 71. Further, the arrangement to latch the toggle lever assembly 71 is complex and requires a latching element that operates against moving latching surfaces. Accordingly, the arrangement of U.S. Pat. No. 4,124,790 includes complex, indirect latching and a complex arrangement to transmit force and movement from the drive lever member 123 to the switch operating member 77.

U.S. Pat. Nos. 3,913,459, 3,835,277 and 3,646,292 disclose the advantageous use of ring latches for releasably restraining a movable member in the operating mechanism and other apparatus.

While the aforementioned arrangements are generally useful and satisfactory for their intended use, it is desirable to provide an improved operating mechanism with improved operational features.

An improved operating mechanism is disclosed and claimed in commonly-assigned, copending application Ser. No. 721,613 filed in the name of Chester H. Lin on Apr. 10, 1985, and now U.S. Pat. No. 4,578,551 . While the operating mechanism disclosed therein is entirely suitable for many types of switch operating applications, the present invention is directed to an improved linear operating mechansim of the basic type disclosed in the aforementioned application and that includes particular features that are desirable for certain switch operating applications including linear motion, compact design, the control of three phases of a switch arrangement, and the requirement for higher operating forces.

SUMMARY OF THE INVENTION

Accordingly, it is a principal object of the present invention to provide an improved linear operating mechanism for electrical switches that is capable of providing high switch-operating forces, that is capable of opening the switch immediately after closing of the switch, that is charged to store switch-closing and switch-opening operating forces by moving a member in a single direction, and that utilizes a selectively releasable latch that directly acts on the operating member.

It is another object of the present invention to provide an improved linear operating mechanism for electrical switches wherein movement of a carriage in a first direction charges an opening spring and a closing spring with stored operating energy, the carriage and a switch-operating member being disposed for movement along linear, parallel paths.

It is a further object of the present invention to provide an improved linear operating mechanism for electrical switches that includes linear moving operational members and directly acting latch arrangements therefor, the latch arrangements including a gapped latch ring carried by each of the operational members and a latch member for each of the latch arrangements, each of the latch members being carried by the operating mechanism housing and being received in the gap of the respective latch ring, the latch member being disposed for slidable and pivotal movement with respect to the plane of the cooperating latch ring.

It is yet another object of the present invention to provide an improved linear operating mechanism that includes orientation control arrangements to control the orientation of the linearly movable operational members.

It is a further object of the present invention to provide an improved linear operating mechanism for electrical switches that includes interfitting operational components moving along parallel, linear paths to achieve high switch-operating forces and a relatively lightweight, compact operating mechanism.

It is yet another object of the present invention to provide an improved linear operating mechanism for electrical switches wherein a switch operating member, a carriage, an opening spring, and a closing spring are all disposed about a common axis; the closing spring acting between the switch operating member and the carriage, the opening spring acting between the carriage and the housing of the operating mechanism, the carriage and the switch-operating member being disposed with respect to the housing for movement along a linear path, the carriage and the switch-operating member interfitting with each other, and the closing spring being disposed within the carriage and about the switch operating member.

It is a further object of the present invention to provide an improved operating mechanism for electrical switches including the coaxial arrangement of a switch operating member, a carriage, an opening spring and a closing spring, the opening and closing springs being arranged one within the other so as to be concentric over a major portion of their lengths when both are charged or discharged, and the carriage being arranged to directly act against the switch operating member when the carriage is moved in a predetermined direction.

Briefly, in accordance with important aspects of the present invention, there is provided an improved linear operating mechanism for operating one or more electrical switches or interrupters, the mechanism selectively closing the switch via movement of a switch operating member and immediately thereafter being capable of opening the switch as required. The operating mechanism includes a carriage that is movable over a linear path to charge an opening spring and a closing spring. The opening spring is operative between the housing of the operating mechanism and the carriage. The closing spring is operative between the switch operating member and the carriage. The switch operating member is movable along an axis parallel to or coincident with the path of the carriage. A first latch arrangement is provided for preventing switch-closing movement of the switch operating member when the switch is open and the first latch arrangement is engaged. A second latch arrangement is provided for preventing movement of the carriage opposite to the direction of charging movement after the springs are charged and when the second latch arrangement is engaged. The opening spring and the closing springs are disposed about a common axis parallel to the movement of the carriage and the switch operating member.

After charging, and when it is desired to close the switch, the switch operating member is released via the first latch arrangement and the closing spring drives the switch operating member to close the switch. Thereafter, when it is desired to open the switch, the carriage is released via the second latch arrangement and moves in the direction opposite to that of the charging movement. In this direction of movement, the carriage acts against the switch operating member to move the switch operating member to open the switch. The carriage, the switch operating member, and the closing spring all move in unison to an initial position as the switch is opened; the operating mechanism again being ready for charging.

The latch arrangements each include a gapped latch ring that cooperates with a latch member that is received within the gap of the latch ring. The carriage and the switch operating member each carry one of the latch rings. The latch rings are resilient members utilized operatively as compression springs; i.e. they are predisposed to occupy a space larger than the housing within which they are contained. A control surface is provided at the site of each of the latch members that allows the latch ring to expand with respect to the normally compressed state in which the respective carriage or switch operating member is freed for movement. When the latch ring expands, the latch member is operative to enter the gap in the latch ring. Each latch member is slidable with respect to the plane of the associated latch ring to accomplish latching and trip release movement. The latch members are also pivotal with respect to the plane of the latch rings for desirable operating features and reliable operation. For latching, the latch member is positioned to a point whereat the latch ring will contact the latch member as the latch ring moves over the control surface to allow expansion of the gap. The latch ring moves against and pivots the latch member as the latch ring is expanding. Accordingly, the latch member is ready to enter the ring as the gap is presented. For example, the carriage latch ring expands and the latch member enters the gap of the latch ring as the carriage is moved by a charging force to position the latch ring at the widened section of the control surface that allows expansion of the latch ring. During this charging operation, the switch operating member is latched against movement. When the charging force is removed, the carriage is urged by the charged springs to force the latch ring against the tapered portion of the control surface which forces the latch ring to contract against the latch member. The latch member prevents the latch ring from contracting below the diameter at which the control surface retains the latch ring; i.e. the latch ring cannot narrow to the diameter required to release the carriage for movement. When the latch member is withdrawn from the latch ring to release the carriage, the latch ring is compressed and narrows in diameter and moves off the tapered portion of the control surface, thus releasing the carriage for movement.

The latch arrangement for the switch operating member operates similarly to the carriage latch arrangement. The latch ring carried by the switch operating member expands against the respective control surface after the switch operating member moves in the switch-opening direction to an initial position whereat the latch member enters the gap. During charging, as a force is exerted on the switch operating member, the latch ring is forced against the tapered portion of the control surface with the latch member limiting the contraction of the latch ring, thus latching the switch operating member against movement in the switch-closing direction. When the latch member is withdrawn from the gap to effect switch-closing operation, the latch ring contracts and releases the switch operating member.

The operating mechanism is arranged for volumetric space efficiency with the carriage and the switch operating member being coaxially arranged and interfitting. The closing spring is also housed within the carriage.

Orientation control arrangements are provided to control the orientation of the carriage and the switch operating member with respect to the latch member. The control arrangement also includes provisions for controlling the orientation of each latch ring with respect to the carriage or the switch operating member which carries the respective latch ring.

BRIEF DESCRIPTION OF THE DRAWING

The invention, both as to its organization and method of operation, together with further objects and advantages thereof, will best be understood by reference to the following specification taken in conjunction with the accompanying drawing in which like reference numerals refer to like elements and in which:

FIGS. 1 through 3 are diagramatic representations of the operating mechanism of the present invention illustrating the following respective operational states:

FIG. 1—switch open, springs discharged;

FIG. 2—switch open, springs charged; and

FIG. 3—switch closed, closing spring discharged, opening spring charged;

FIG. 5 is an elevational view, partly in section, of the carriage of the operating mechanism of FIG. 4;

DETAILED DESCRIPTION

Figure 4:
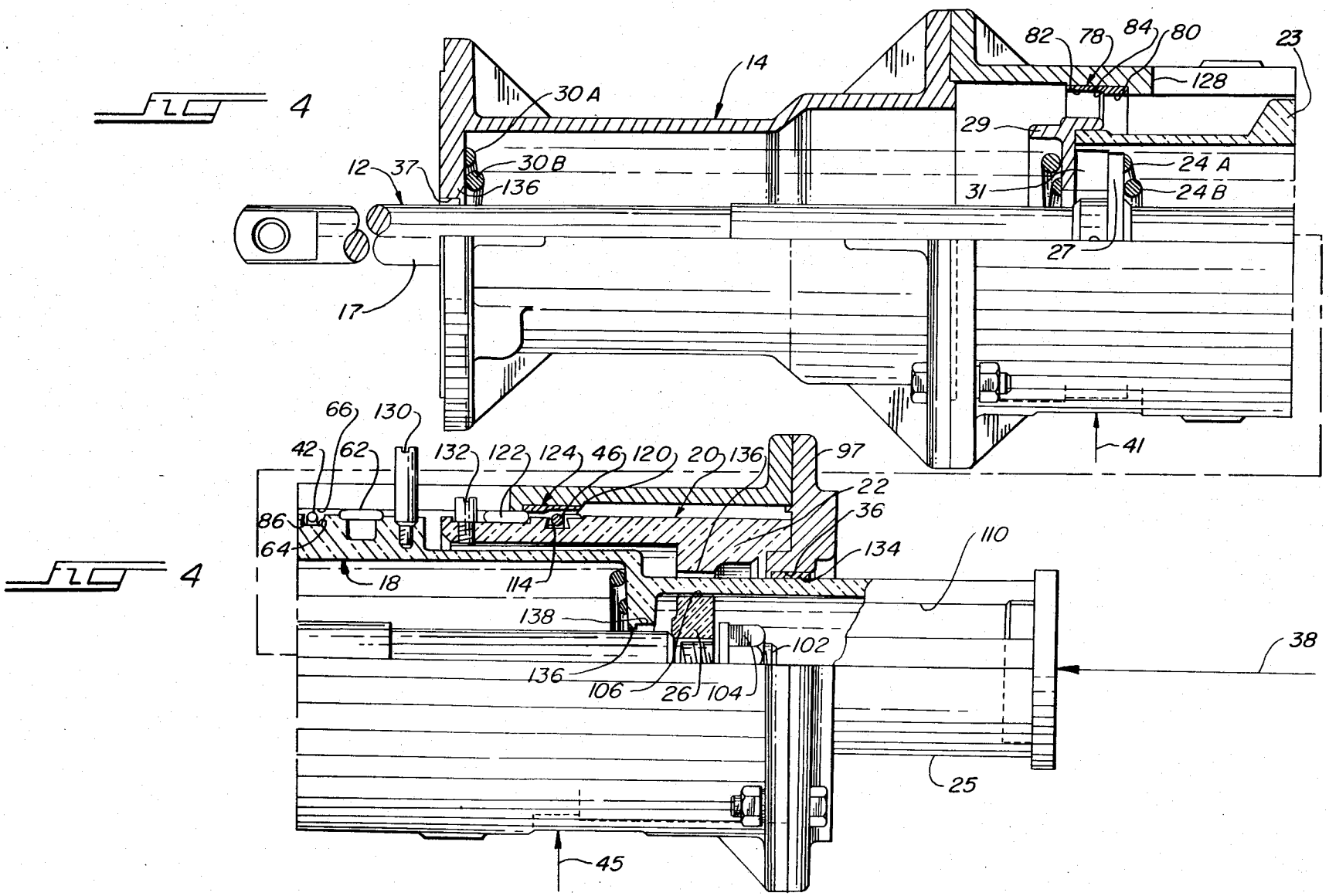
FIG. 4 is an elevational view, partly in section and with parts cut away, of a preferred embodiment of the operating mechanism of the present invention.

Referring now to FIGS. 1–3, and considering first the basic function and structure of the present invention, the operating mechanism 10 includes a switch operating member 12 slidably carried by a housing 14 of the operating mechanism. The switch operating member 12 is arranged for movement between two predetermined positions along a reciprocative path along the axis 16. Through suitable linkage, referred to generally at 13, the switch operating member 12 operates one or more electrical switches between open and closed positions corresponding respectively to the two predetermined positions of the switch operating member 12. The switch is diagrammically represented at 15 by the illustrated contacts. Considering an illustrative example in connection with FIGS. 1–3, the switch operating member 12 is positioned and moved in the upward direction to close the switch and in the downward direction to open the switch. The position of the switch operating member 12, in FIG. 1, corresponds to the switch-open position represented by the switch 15. A carriage 18 is also slidably carried with respect to the housing 14 and is also movable along the linear reciprocative path 16. While a linkage 13 is discussed, it should be understood that in specific applications the switch operating member 12 is arranged to directly actuate one or more switches.

The switch operating member 12 and the carriage 18 interfit and are coaxially arranged with respect to the common axis 16 of the operating mechanism 10. The switch operating member 12 includes a central operating rod 17 and a lower, circumferential, shell portion 20 with a base 22 that is affixed to the operating rod 17. The carriage 18 includes a cylindrical shell portion 23 and a lower, narrowed portion 25. The lower portion 25 of the carriage 18 is bifurcated and fits through openings in the base 22 of the switch operating member 12. The upper, cylindrical shell portion 23 of the carriage 18 circumferentially surrounds the operating rod 17 of the switch operating member 12.

A closing spring 24 is disposed between the base 26 of the shell portion 23 and a widened, intermediate flange 27 of the switch operating member 12. The carriage 18, at the upper end of the carriage portion 23, includes a cylindrical cap 28 with an upstanding, circumferential edge 29. An opening spring 30 is disposed between an upper portion 32 of the housing 14 and the cap 28. The cap 28, in the positions shown in FIGS. 1 and 3, is arranged to act against the flange 27 through a shock absorber disc 31. The lower portion 25 of the carriage 18 extends through an opening 36 in the lower end of the housing 14. The operating rod 17 extends through an opening 37 in the upper end of the housing 14.

In accordance with the practice of the present invention, a unidirectional charging force represented by arrow 38 is applied to the carriage 18 via the portion 25 in a direction generally axially aligned with the reciprocative path along axis 16. In response to the charging force at 38, the carriage 18 is moved from the position of FIG. 1 to the position as shown in FIG. 2. A latch arrangement 40 is provided to selectively latch the carriage 18 in the upper position as shown in FIG. 2. The latch arrangement 40 includes a selectively operable latch device at 41 and a latch receiving member 42. The latch receiving member 42 is carried by the carriage 18 so as to be in alignment with the selectively operable latch device 40 when the carriage 18 is in the charged position as shown in FIG. 2. As will be explained in more detail hereinafter, the latch receiving member 42 in a preferred embodiment is a latch ring including a gap that receives the selectively operable latch device 41. The latch arrangement 40 retains or latches the carriage 18 in the position as shown in FIG. 2 after the force 38 has been removed.

Similarly, a latch arrangement 44 is provided to selectively latch the operating member 12 in the position shown in FIGS. 1 and 2. The latch arrangement 44 includes a selectively operable latch device at 45 and a latch receiving member 46 carried by the operating member portion 20. During the application of the charging force at 38 to move the carriage 18 from the position shown in FIG. 1 to the position shown in FIG. 2, the switch operating member 12 is latched in the stationary position illustrated in FIGS. 1 and 2. The latch receiving member 46 in a preferred embodiment is a latch ring including a gap that receives the selectively operable latch device 45. Latch arrangements of this general type are disclosed in U.S. Pat. Nos. 3,646,292, 3,835,277 and 3,913,459.

Accordingly, when the carriage 18 is moved from the position in FIG. 1 to the position in FIG. 2, the closing spring 24 is compressed between the circumferential base 26 of the carriage 18 and the flange 27 of the switch operating member 12; the flange 27 remaining stationary as the carriage base 26 moves upward. As the carriage 18 moves to the charged position, as shown in FIG. 2, the opening spring 30 is simultaneously compressed between the cap 28 of the carriage 18 and the upper frame portion 32.

To summarize the charging cycle of operation, the unidirectional charging force at 38 moves the carriage 18 from the position in FIG. 1 to the position in FIG. 2 while the switch operating member 12 is latched so as to remain stationary and the opening spring 30 and the closing spring 24 are compressed so as to be charged with respective operating energies after the carriage 18 has reached the position as shown in FIG. 2; the latch arrangement 40 having been operated prior to charging so as to restrain the switch operating member 12, the latch arrangement 42 being operative at the end of the charging cycle to restrain the carriage 18.

When it is desired to close the switch 15 via the switch operating member 12, the latch device 44 is controlled to release the switch operating member 12 whereupon the switch operating member 12 in response to the energy stored in the closing spring 24 is moved in the direction of arrow 48 from the configuration of FIG. 2 to that of FIG. 3; the operating member 12 being moved with respect to the latched, stationary carriage 18. Accordingly, with the switch 15 closed, as shown in FIG. 3, the energy stored in the closing spring 24 during the charging operation has now been discharged while the opening spring retains the energy stored during the charging operation.

When it is desired to open the switch contacts 15, the latch device 40 is controlled to release the carriage 18 for movement from the configuration of FIG. 3 to the configuration of FIG. 1 with the switch 15 being opened by movement of the switch operating member 12 in the direction indicated by arrow 50 in FIG. 3; the opening spring 30 acting through the cap 28 to move the carriage 18 downward and movement of the cap 28 also acting through the shock absorber 31 against the flange 27 to move the switch operating member 12. Accordingly, as the opening spring 30 discharges the stored energy, the carriage 18 and the switch operating member 12 are moved downward to the position of FIG. 1, the switch contacts 15 are opened, and the operating mechanism 10 is ready for the charging operation. The energy status of the closing spring 24 remains unchanged during the opening cycle as both ends of the closing spring 24 are simultaneously moved over the same distance; i.e. there is no relative movement across the ends of the closing spring 24.

In accordance with the features of the present invention, the operating mechanism 10 receives a unidirectional charging input at 38 and, as desired thereafter, the operating mechanism 10 is selectively operable to close the switch contacts at 15 via movement of the switch operating member 12 in a first direction 48 and is immediately thereafter capable of being selectively operable to open the switch contacts via movement of the operating member in a second direction 50, opposite to that of the first direction 48. This provides a trip-free or release-free operation; i.e. the operating mechanism is immediately available to open the switch contacts after closing without the intervention or requirement of additional force inputs or control cycles.

Considering the general structural and functional relationships of the carriage 18 and the switch operating member 12, these slidable control members having cylindrical portions and operating within the generally cylindrical housing 14 can also be referred to as a closing latch piston assembly for the carriage 18 and an opening latch piston assembly for the switch operating member 12.

While the switch operating member 12 is illustrated with the shell portion 20, it should be realized that in another specific embodiment only the base 22 is provided and the remaining portions of the shell 20 are omitted. In that arrangement, the latch ring 46 is carried by the base 22.

Turning now to FIG. 4 and a discussion of the detailed structure and features of a preferred embodiment of the operating mechanism 10 wherein like reference numerals refer to corresponding components of FIGS. 1–3, the lower portion 25 of the carriage 18 is provided with an end cap 52 that is directly contacted and lifted by a unidirectional force represented by arrow 38. The force represented at 38 can be supplied in various manners including hydraulic or pneumatic lift devices, or by direct contact from a rotating cam member.

Figure 6:
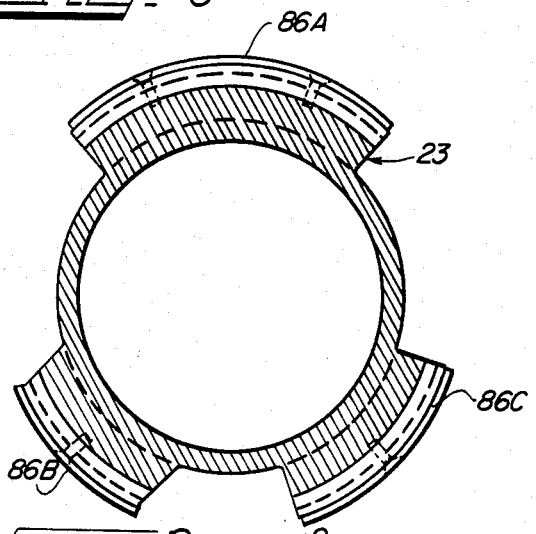
FIG. 6 is a sectional view of the carriage taken along the line 6—6 of FIG. 5.

Referring now additionally to FIGS. 5 and 6, the carriage 18 is slidably supported within the housing 14 by a suitable sleeve bearing 62. The latch ring 42 is carried by the carriage 18 within a circumferential receiving groove or channel 64 formed in the carriage shell portion 23. The latch ring 42 is a resilient member having a tendency to expand in diameter; i.e. the latch ring 42 is utilized operatively as a compression spring. With the latch ring in the position of FIG. 4, expansion of the latch ring 42 is limited by the inner wall 66 of the housing 14. The latch ring 42 is free for expansion within and about the groove 64 in the vicinity where the ring cooperates with the latch device indicated generally at 41 in FIG. 4 to perform the latching and releasing function as will be explained in more detail hereinafter. The latch ring 42 includes a semi-cylindrical notch 68. The notch cooperates with a threaded pin 70 which is affixed to the carriage shell portion 23. Accordingly, the selected placement of the pin 70 prevents rotation of the ring latch 42 with respect to a predetermined circumferential orientation. In accordance with another aspect of the present invention, a sleeve 86 having an inverted L-shaped cross-section is affixed to the carriage portion 23 immediately adjacent the latch ring 42 to accomodate stresses transmitted from the latch ring 42 to carriage portion 23. As seen in FIG. 6, in a specific embodiment the sleeve 86 is provided by circumferential portions 86A, 86B and 86C.

Figure 7:
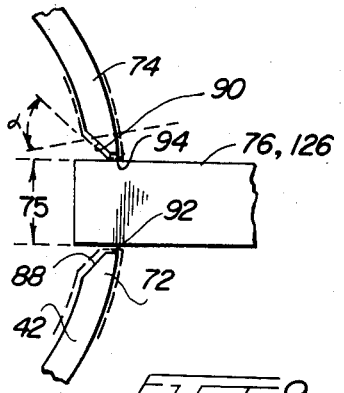
FIG. 7 is an elevational view of the latch ring of FIGS. 4–6 and the latch member for cooperation with the latch ring to provide a latch arrangement.

Referring now additionally to FIG. 7, the latch ring 42 is a torus with a segment removed to provide a gap 75 and spaced apart ends 72,74. The gap 75 receives the selectively operable latch member 76 of a latch device operatively positioned as indicated at 41 in FIG. 4. The latch member 76 is positioned at a predetermined circumferential position about the housing 14 and cooperates with the gap 75 of the ring 42 at latch ends 72,74. Accordingly, the control of the orientation of the latch ring 42 with respect to the carriage 18, housing 14 and latch member 76 at latch site 41 is desirable for increased efficiency and reliability of the latching arrangement since any changes in the orientation necessiate accomodations in the range of the gap 75 provided by the expansion and contraction of the latch ring 42.

In a specific embodiment, the ends 72,74 of the latch ring 42 include tapered surfaces 88,90 to provide narrowed contact faces 92,94 that are aligned so as to be parallel with the received, engaged portions of the latch member 76. The tapered surfaces 88,90 are defined by planes perpendicular to the plane of the ring and forming a defined angle $\alpha$ with respect to the cross section of the ring. The ends 72,74 are hardened by heat-treating for desirable operating life and characteristics.

The latch ring 42 cooperates with a housing sleeve 78 that is affixed to the housing wall 66 so as to be circumferentially disposed around the area of the latch site 41 and the position of the latch member 76. As the carriage 18 is moved upward from the position shown in FIG. 4 to the position corresponding to that represented in FIG. 2 wherein the latch ring 42 is aligned with the latch site 41, the latch ring 42 moves from a narrowed, smaller diameter circumferential portion 80 of the housing sleeve 78 to a widened circumferential diameter portion 82 with the two surfaces 80,82 being connected by a sloped, neck portion 84. As the carriage 18 moves upward from the position as shown in FIGS. 1 and 4 to the position of FIG. 2, the latch ring 42 which has been compressed so as to narrow the gap 75 between the ends 72,74, now expands as it moves from the housing sleeeve portion 80 to the sloped portion 84 and on to portion 82. As the latch ring 42 expands, it moves in contact with the surface 84 and then the surface 82. When the latch ring 42 is aligned with the surface 82, the latch ring 42 expands to provide a gap 75 sufficient to allow the receiving of the latch member 76, allowing for component and orientation tolerances.

At this point in the charging cycle, the carriage 18 has been lifted to the position shown in FIG. 2. As the lifting force 38 is reduced and/or removed, the latch ring 42 moves down the sloped, control surface 84 due to the urging force of the springs 24 and 26 and the weight of the carriage 18 and attached parts. However, in accordance with the predetermined dimensional relationships and tolerances, the spring latch 42 only moves a portion of the way down the control surface 84 since the latch ring 42 is restrained from further compression due to the presence of the latch member 76 in the gap 75. Accordingly, when the lifting force at 38 is removed, the carriage 18 remains latched in the position shown in FIG. 2 as discussed hereinbefore.

With the carriage 18 in the position of FIG. 2 and the latch member 76 holding the latch ring in the expanded position as shown in FIG. 7, the carriage 18 is latched against movement in a downward direction, opposite to that of arrow 48 in FIG. 2. When it is desired to relase the carriage 18, for example after the switch 15 has been closed by release of the closing spring 24 and when it is desired to open the switch 15, the latch member 76 is withdrawn in a direction 96 (FIG. 7) at the latch site 41 and away from the housing 18 and the latch ring 42. When the latch member 76 clears the gap 75 between the ends 72,74, the latch ring 42 will move down the control surface 84 and be compressed due to the force transmitted from the opening spring 30 against the cap 28 and the weight of the carriage 18 and attached components. As the latch ring 42 is compressed or narrowed in diameter, the gap 75 is also reduced and the latch ring 42 moves down the control surface 84 and follows the control surface 80. The carriage 18 urges the ring 42 along the control surfaces and down the inside walls 66 of the housing 14 to return from the position of FIG. 3 to FIG. 1.

Figure 8:
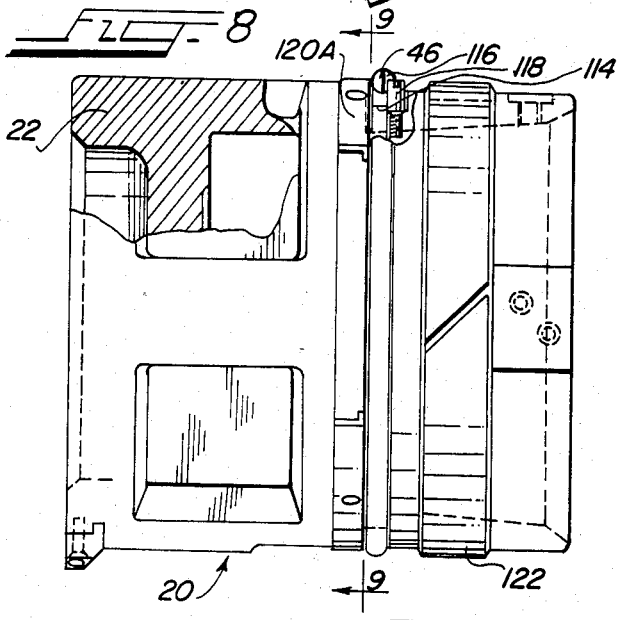
FIG. 8 is an elevational view, partly in section and with parts cut away, of the lower portion of the switch operating member of the operating mechanism of FIG. 4.
Figure 9:
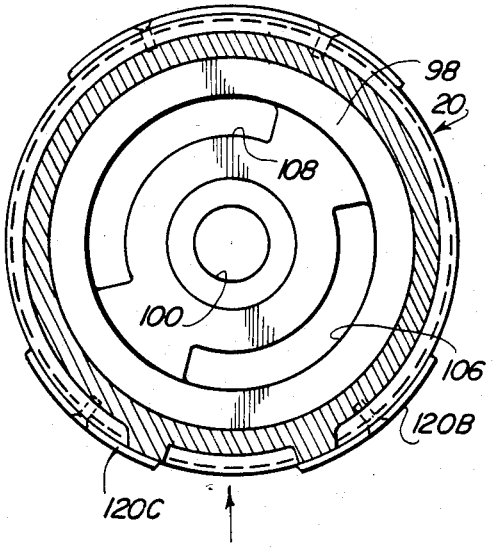
FIG. 9 is a sectional view of the switch operating member taken along line 9—9 of FIG. 8.

Turning now to a more detailed discussion of the switch operating member 12, and referring additionally to FIGS. 8 and 9, the operating member portion 20 includes a central aperture 100 in the base 22 through which a threaded, narrowed portion 102 of the rod 17 passes. The rod 17 and the portion 20 are affixed by a nut 104 threaded onto the portion 102 and against the base 22. The base 22 includes two arcuate apertures 106,108 through which the lower bifurcated portion 25 of the carriage 18 interfits for allowing relative movement between the carriage 18 and the operating member 12 along path 16. The bifurcated portion 25 of the carriage 18 is formed by elongated slots 110,112 disposed for clearance with the base 22 of the operating member portion 20. The base 26 of the carriage portion 23 includes an aperture 136 through which the rod 17 passes.

As seen in FIG. 5, the latch ring 46 is arranged to be carried in a circumferential channel or groove 114 formed in the portion 20 of the switch operating member 12. Similarly to the latch ring 42, the latch ring 46 includes a slotted portion 116 for cooperation with a threaded pin 118 for orientation purposes as discussed hereinbefore. A sleeve 120, including circumferential portions 120A, 120B and 120C is affixed to the portion 20 immediately below the latch ring 46 for purposes similar to that of the sleeve 86. Similarily, a sleeve bearing 122 is provided about the portion 20 for slidably mounting the switch operating member 12 with respect to the housing 14.

At latch site 45, a housing sleeve 124 esentially identical to that of the housing sleeve 78 is positioned to cooperate with the latch ring 46 at latch site 45 and with a latch member 126. The interaction of the latch ring 46 with housing sleeve 124 and latch member 126 is generally as discussed above in connection with the latch arrangement 40 of the carriage 18.

For example, when the switch 15 is opened as represented by the sequence of FIG. 3 to FIG. 1, as the switch operating member 12 with portion 20 moves downward, the latch ring 46 which has been compressed against the housing wall 66 begins to expand against the control surface 84 of the housing sleeve 124. The latch arrangement 44 at latch site 45 is operative with the latch member 126 being received in the gap 75 as the latch ring 46 expands. Accordingly, during the charging cycle of FIG. 1 to FIG. 2, as the carriage 18 is raised from the position of FIG. 4 by the lifting force 38, the latch arrangement 44 is operative to maintain the switch operating member 12 stationary with the latch member 126 holding the latch ring 46 in the expanded condition against the control surface 84. The latch ring 46 cannot be compressed to move away from the control surface 84 to surface 80 unless the latch member 126 is withdrawn from the gap 75. The switch operating member 12 remains stationary during the charging cycle to result in the representation of FIG. 2 while the opening spring 30 and the closing spring 24 are charged.

Subsequently, and after the latch arrangement 40 is operative to latch the carriage 18 against movement, and when it is desired to close the switch 15, the sequence from FIG. 2 to FIG. 3 results wherein the latch member 126 is withdrawn from the gap 75 of the latch ring 46. The switch operating member 12 is released for movement as the closing spring 24 releases the stored energy and acts against the base 26 of the carriage 18 to transmit force against the flange 27 of the operating rod 17. The latch ring 46 compresses and moves along the control surface 84 onto surface 80 and the housing wall 66.

Figure 10:
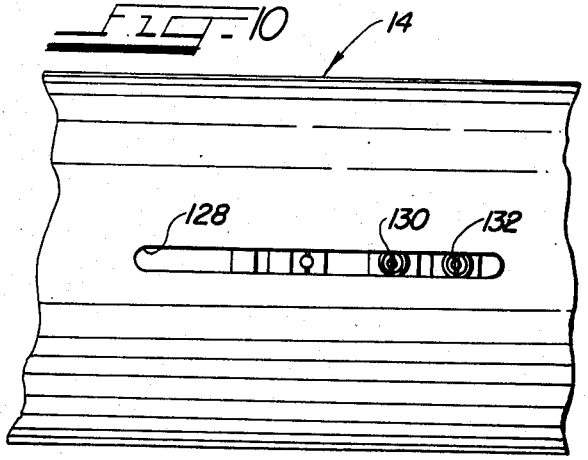
FIG. 10 is a plan view, partly in section and with parts cut away, of the operating mechanism of FIG. 4.

Considering now other structural features and details of the preferred embodiment of the operating mechanism 10 of the present invention and referring additionally to FIG. 10, an alignment arrangement is provided for preventing circumferential rotation of the carriage 18, switch operating member 12 and latch rings 42,46 with respect to the housing 14. Specifically, an elongated slot 128 is provided through the housing 14 and a threaded pin 130 is fixedly carried by the carriage 18 so as to be aligned with the slot 128 in a predetermined circumferential relationship with respect to the latch site 41. Similarily, a second threaded pin 132 is fixedly carried by the operating member portion 20 of the switch operating member 12 in alignment with the slot 128 when the latch ring 46 is properly aligned with the latch member 126 at the latch site 45. The aperture 36 that provides clearance for passage of the portion 25 of the carriage 18 through the housing base 97 is provided with a bushing 134. Similarily, an upper bushing 136 is provided in the aperture 37 of the upper housing portion 32 through which the operating rod 17 exits the housing 14. A bearing member 136 is provided in the aperture 138 of the base 26 of the carriage portion 23 through which the rod 17 passes.

In accordance with other aspects of the preferred embodiment of the present invention, the closing spring 24 is implemented by two coaxially arranged springs 24A and 24B arranged one within the other to provide increased closing forces within a minimum volumetric space requirement. Further, the opening spring 30 is implemented by two coaxially arranged springs 30A and 30B for similar compact design features. The combination of the springs 30A, 30B, 24A, and 24B, the interfitting carriage 18 and switch operating member 12, and the latch arrangements 40 and 44 reduces the overall height, width and volumetric space required for the operating mechanism 10 while providing desirable features including increased operating forces and speed for increased efficiency and optimum performance. For example, as seen in FIG. 4 in the uncharged state, the portion 20 of the switch operating member 12 substantially overlaps and encircles the carriage 18. Similarily, the carriage 18 substantially encircles a significant portion of the length of the operating member 12. The general coaxial interfitting relationship of the members 12 and 18 enhances the volumetric space efficiency of the preferred embodiment. Further, the provision of the carriage 18 being adapted to directly act against the switch operating member 12 in the switch-opening direction also provides reliability and eliminates complex mechanical linkages and toggles.

Figure 11:
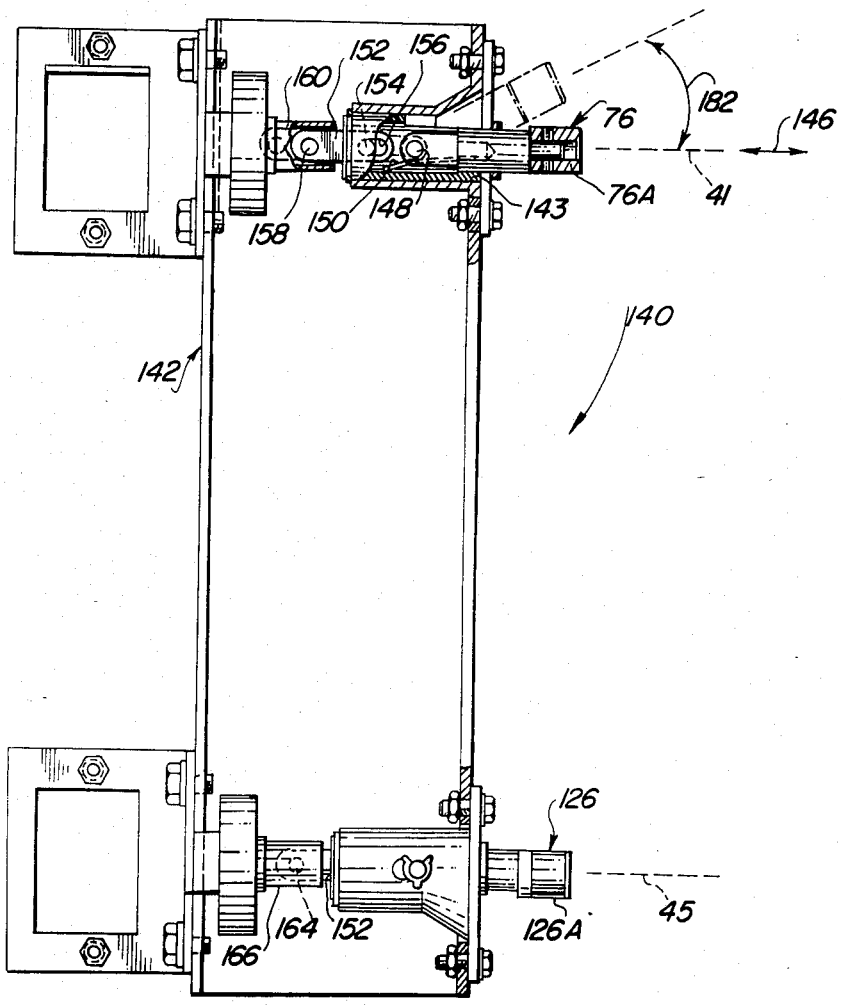
FIG. 11 is an elevational view, partly in section and with parts cut away, of a latch control arrangement that controls the latch members of the operating mechanism of FIG. 4.
Figure 12:
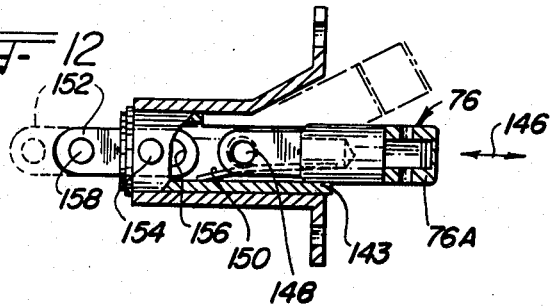
FIG. 12 is an enlarged, sectional view, with parts cut away, of one of the latch members and a portion of the latch control arrangement of FIG. 11.

Considering now the latch arrangements 40 and 46 in more detail and referring now to FIGS. 11 and 12, each of the latch members 76,126 is selectively operable with respect to a latch operator 140 having a housing 142. The latch housing 142 appropriately positions the latch members 76,126 for alignment with the respective latch sites 41,45 when the latch housing 142 is aligned and preferably coupled to the housing 14 by suitable fasteners. Each of the latch members 76,126 is slidably disposed in a sleeve 143 that is in turn slidably mounted in a bushing 144 for movement along a path 146. The bushing 144 is fixed to the latch housing 142. The latch members 76,126 are also pivotally mounted with respect to the sleeve 143 about a pivot pin 148. The sleeve is cut away to allow pivoting of the latch members 76,126 about the pivot pin 148. A spring 150 biases the latch members 76,126 to the horizontal position as shown in FIGS. 11 and 12. The latch members 76,126 are generally cylindrically-shaped with block-shaped head portions 76A, 126A. An actuator link 152 is slidably mounted to the sleeve 143 by a pin 154 carried by the sleeve 143 and received within an elongated slot 156 in the link 152, providing lost-motion coupling between the actuator link 152 and the sleeve 143. The actuator link 152 for latch member 76 is pinned at 158 to a solenoid plunger 160 of an opening latch solenoid 162. The actuator link 152 for the latch member 126 is pinned at 164 to a solenoid plunger 166 of a closing latch solenoid 168. Each of the solenoids 162,168 is appropriately controlled or energized to release the respective latch members 76,126 by driving the solenoid plunger and latch member to the left in FIG. 11.

In accordance with another feature of the present invention, the pivoting of the latch members 76 and 126 throughout the angular range 182 provides for high speed, reliable operation to engage the notch 75 of the respective latch ring 42,46. For example, as the latch ring 42 and carriage 18 move upward during the charging cycle and as the latch ring 42 reaches the zone of the latch site 41 along the housing sleeve 78, the latch member 76 is contacted by the ring ends 92,94 even before the ring expands to present the appropriate gap 75 to interfit about the latch member 76. The latch ring 42 contacts and pivots the latch member 76 in the range 182; the latch member 76 entering the gap 75 when the ring 42 reaches the correct expansion. Accordingly, the latch arrangement of the present invention provides for optimum reliability and operation of the latch arrangements 40,44 since there is no necessity to wait for the latch ring 42 to expand and stabilize before the latch member 76,126 is inserted. The latch member 76 awaits the arrival of the ring 42 and proper size of gap 75; the latch arrangement 40 automatically being set dependent only on the arrival of the ring 42 and not on delayed operation of the latch member 76 after the ring 42 or proper gap 75 is sensed as being available.

Figures 13, 14, 15:
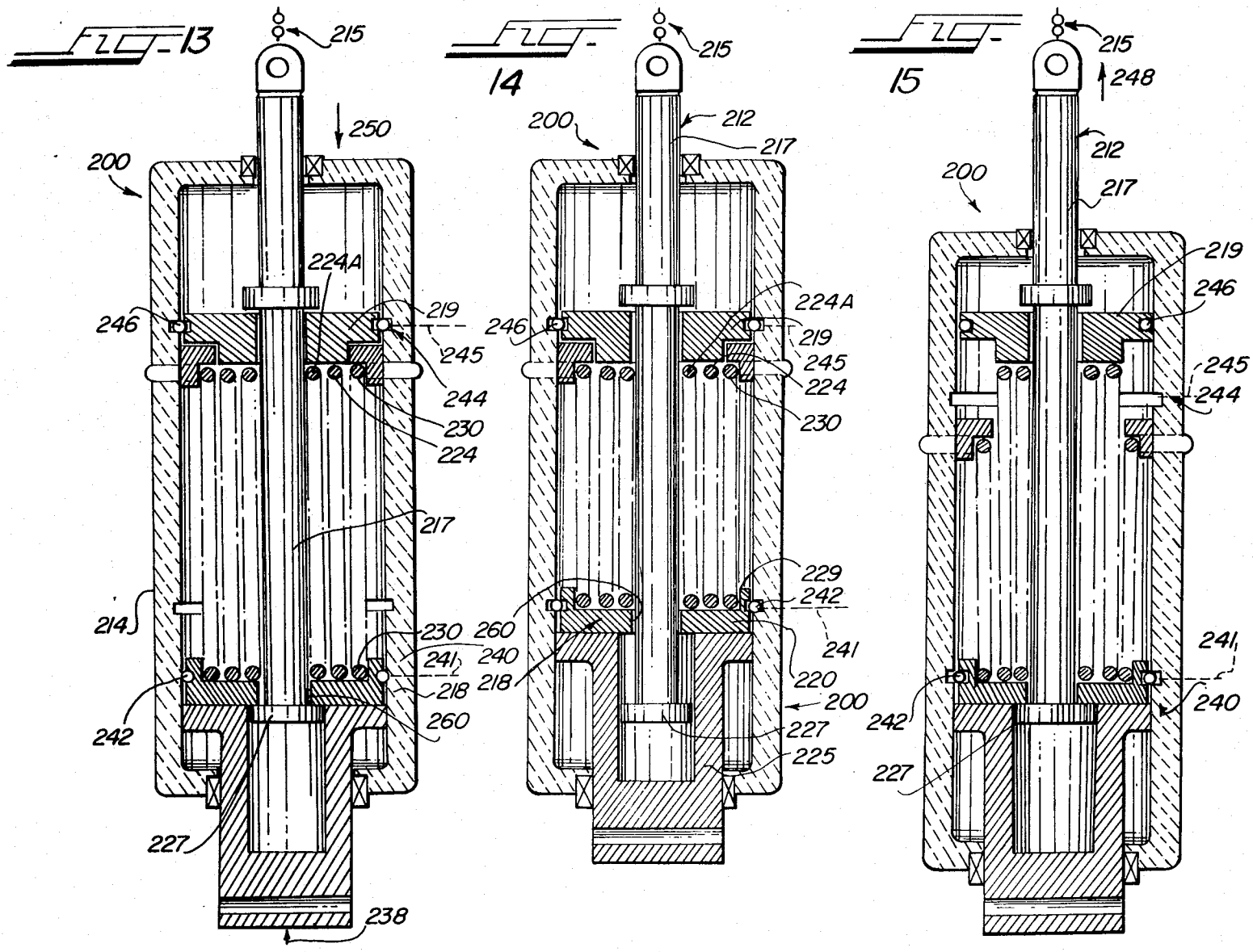
FIGS. 13–15 are elevational views, partly in section, of an alternate arrangement of the present invention and illustrating the respective operational states corresponding respectively to FIGS. 1–3.

Referring now to FIGS. 13–15 and considering an alternate embodiment of the operating mechanism of the present invention, the operating mechanism 200 includes a closing spring 224 that is disposed within an opening spring 230 so as to be concentric over a major portion of their lengths when both springs are charged or discharged. This arrangement provides a compact and efficient design having a different shape factor than the operating mechanism 10 of FIGS. 1–12; the operating mechanism 200 being shorter in length than the operating mechanism 10 for the same switch application, and the operating mechanism 200 possibly being wider than the operating mechanism 10 for the same switch application due to the possible requirement of one or more additional closing springs 224A resulting from the decreased length and charging stroke of the closing spring. For example, if two closing springs and two opening springs were utilized in the arrangement of FIGS. 1–12, three or four of each such springs may be desirable or required in the arrangement of FIGS. 13–15.

The operating mechanism 200 includes a switch operator member 212 similar to switch operating member 12. The switch operator member 212 includes an elongated rod 217. The switch operating member 212 includes a widened top portion 219 that is slidably mounted for linear path movement with respect to a housing 214. A selectively releasable latch arrangement 244 similar to the arrangement 44 is provided for the switch operating member 212 and includes a latch member 245 carried by the housing 214 for operative alignment and cooperation with a latch ring 246 carried by the switch operating member portion 219. The latch member 245 is aligned with the latch ring 246 in the switch-open, spring discharged position of FIG. 13. A carriage 218 is provided including a lower cylindrical shell portion 225 that receives a lifting force 238 for charging and a widened portion 220 having an upstanding wall 229. The carriage 218 is slidably mounted with respect to the housing 214. A selectively releasable latch arrangement 240 is provided for the carriage 218 similar to latch arrangement 40 for the carriage including a latch member 241 carried by the housing 214 for operative alignment and cooperation with a latch ring 242 carried by the carriage portion 220. The latch member 241 is aligned with the latch ring 242 in the springs charged, switch-open position of FIG. 14 and the switch-closed position of FIG. 15.

The closing spring 224 is disposed between the switch operating member portion 219 and the carriage portion 220. The opening spring 230 is disposed between the carriage portion 220 and the housing 214 by means of protuberance 232 extending from the housing 214. The carriage portion 220 includes a central aperture 260 through which the switch operating rod 217 passes. The lower end of the operating rod 217 includes a widened base or flange 227 that is wider than the central aperture 260.

The operating mechanism 200 is illustrated in FIG. 13 in the switch-open, springs discharged position. The springs are charged by the movement of the carriage 218 from the position of FIG. 13 to the position of FIG. 14 while the switch operating member 212 is latched via latch arrangement 244. Accordingly, FIG. 14 illustrates the switch-open, springs charged condition.

When it is desired to close the controlled switch 215, the latch arrangement 244 is operated to release the switch operating member 212. As shown in FIG. 15, when the switch operating member 212 is released, the switch operating member 212 moves in the direction 248 to the switch-closed position to close the switch 215 as the closing spring 224 expands and releases the energy stored during the charging operation.

When it is desired to open the switch 215, the latch arrangement 240 is released. The carriage 218 moves from the latched position of FIG. 15 to the switch-open, spring discharged position of FIG. 13. During this direction of movement, the carriage 218 acting on the flange causes movement of the switch operating member 212 from the switch-closed position of FIG. 15 to the switch-open position of FIG. 13 to close the switch 215.

In certain switch applications, an additional closing spring 224A is provided. Dependent upon the application and the length to diameter ratio of the springs 224,224A, retainers and/or support members are disposed about the springs where such additional support and orientation control is desired.

Figure 16:
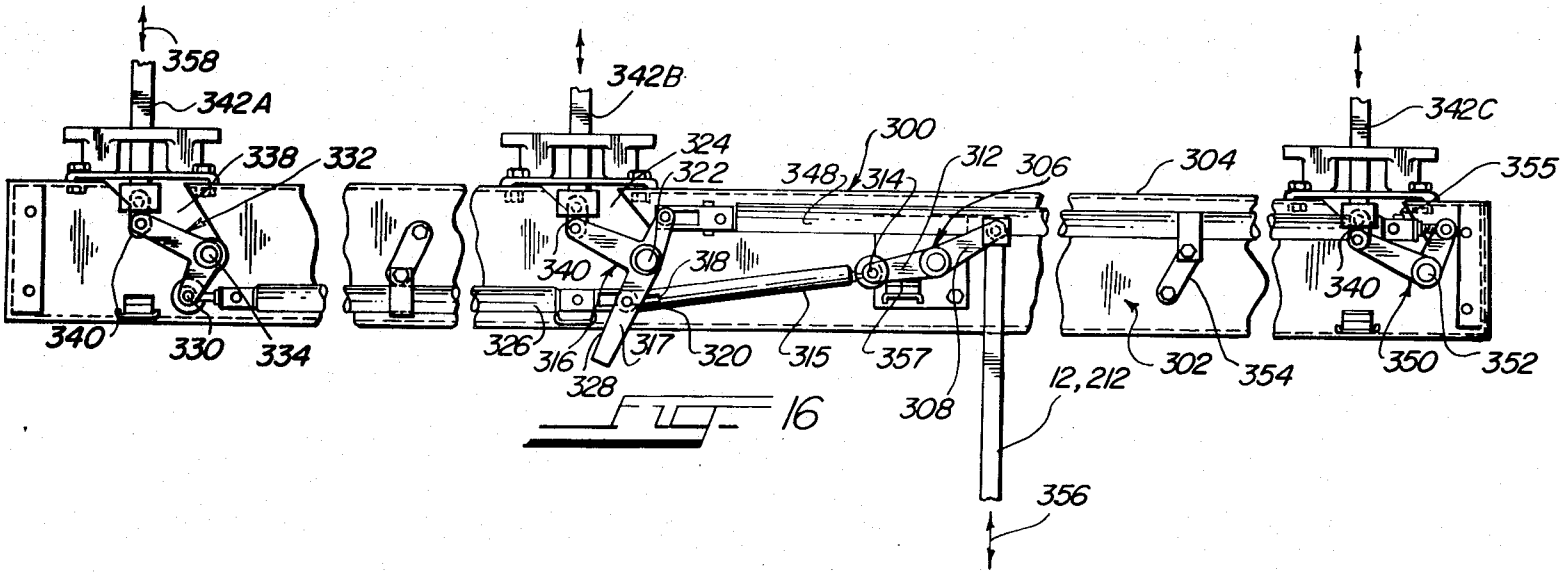
FIG. 16 is an elevational view, with parts cut away, of a base-drive linkage arrangement for use with the operating mechanisms of FIGS. 1–15.

In accordance with further aspects of the present invention and referring now to FIG. 16, the base-drive linkage arrangement 300 is utilized in a preferred use of the operating mechanisms of FIGS. 1–15 for operating a three-pole circuit interrupter by means of driving three operating members 342A-C between respective open and closed positions. For a more detailed discussion of the circuit interrupter and the apparatus providing the operating members 342A-C, reference may be made to commonly assigned, co-pending application Ser. Nos. 721,616 and 721,614 filed in the names of L. V. Chabala et al on Apr. 10, 1985.

The base-drive linkage arrangement 300 includes drive linkage 302 operating with respect to a base support member 304. The drive linkage 302 includes a toggle lever 306. One end 308 of the toggle lever 306 is connected to the switch operating member 12 of FIGS. 1–4 or to the switch operating member 212 of FIGS. 13–15. The toggle lever 306 is pivotally mounted at 310 with respect to the base support member 304. The second end 312 of the toggle lever 306 is pivotally connected at 314 to one end of a toggle link 315. The other end of the toggle link 315 is slidably connected to a drive arm 317 of a center bell crank 316 by means of a pin 320 through a slot 318 in the toggle link 315. The center bell crank 316 is pivotally mounted at 322 with respect to a cross-member 324 carried by the base support member 304; the base support member 304 preferably being a channel member. The pin 320 also slidably mounts one end of a drive link 326 to the center bell crank 316 by means of a slot 328 in the drive link 326. The other end of the drive link 326 is pivotally mounted at 330 to one arm of a left bell crank 332. The left bell crank 332 is pivotally mounted at 334 with respect to a cross-member 338 carried by the base support member 304. A second arm of the left bell crank 332 is connected to drive the operating member 342A by means of a slide link 340 pinned between the operating member 342A and the left bell crank 332. Similarly, a second arm 344 of the center bell crank 316 is connected to drive the operating member 342B via a slide link 340. A third arm 346 of the center bell crank 316 is slidably connected to a drive link 348. The other end of the drive link 348 is pivotally connected to a right bell crank 350 that drives the operating member 342C. The right bell crank 350 is pivotally mounted at 352 by a cross-member 354 carried by the base support member 304. The drive links 326 and 348 are slidably supported with respect to the base support member 304 by idler arm assemblies 355. A travel limit stop arrangement 357 is provided below the arm 312 of the toggle lever 306.

Considering the operation of the base drive linkage arrangement 300, the base-drive linkage arrangement 300 is shown in FIG. 16 in the switch-closed position. For switch-opening operation, the toggle lever 306 is rotated clockwise and the drive links 325 and 348 are each translated toward the center bell crank 316 as the center bell crank 316 is rotated counterclockwise. This movement of the drive links 326 and 348 rotates the left bell crank 332 and the right bell crank 350 counterclockwise. Translation of the switch operating member 12 in the directions indicated at 356 provides coordinated translation of the three operating members 342A-C in the directions 358. Referenced to FIG. 16, upward translation of the switch operating member 12 provides upward translation of the operating members 342A-C, corresponding to the switch-closing direction as discussed previously. Similarly, downward translation of the switch operating member 12 provides downward translation of the operating members 342A-C for switch-opening operation. Accordingly, the base drive linkage arrangement corresponds to the linkage 13 of FIGS. 1—3.

In accordance with another aspect of the present invention, the combination of the base-drive linkage arrangement 300 with the operating mechanism 10 of FIGS. 1–12 or the operating mechanism 200 of FIGS. 13–15 provides additional desirable operating features. Specifically, the base-drive linkage arrangement 300 provides a latch for holding the operating members 342A-C in the switch-closed position until a positive-acting, switch-opening force is provided at the toggle lever 306. This feature is provided even though strong reaction forces are applied to the base-drive, linkage 300 from the operating members 342A-C in the switch-opening direction. Further, the toggle latch 306 remains in a latch-holding state even if the switch operating member 12 is disconnected. The latch feature is provided by the over-center toggle condition of the toggle lever 306; e.g. with respect to the action point at the pin 320 and a line along the toggle link 315. Accordingly, any force applied through the operating members 342A-C and the drive linkage to the toggle lever 306 will urge the toggle lever 306 in the counterclockwise direction; the direction of latching of the toggle while the toggle lever 306 requires rotation in the clockwise direction in FIG. 16 to release the latch condition.

While there has been illustrated and described various embodiments of the present invention, it will be apparent that various changes and modifications will occur to those skilled in the art. It is intended in the appended claims to cover all such changes and modifications as fall within the true spirit and scope of the present invention.

What is claimed and desired to be secured by Letter Patent of the United States is:

1. A linear operating mechanism for an electrical switch, the operating mechanism being capable of immediately reopening the switch after its closure the operating mechanism comprising:

a housing;

a carriage movable along a linear path between first and second positions;

an operating member to effect opening and closing of a switch and being movable between first and second positions along a path parallel to or coincident with the path of said carriage;

a closing spring disposed about said operating member, said closing spring acting between said carriage and said operating member;

an opening spring disposed about an axis parallel to or coincident with said closing spring and acting between said housing and said carriage;

operating member latch means for selectively latching said operating member against movement in a switch-closing direction;

carriage latch means for selectively latching said carriage in said second position; and means responsive to movement of said carriage from said second position to said first position for moving said operating member from said second position to said first position, said carriage being moved from said first position to said second position to charge said opening spring and said closing spring with operating energy while said operating member is latched by said operating member latch means in said first position corresponding to the switch-open position, said carriage being latched by said carriage latch means when said carriage reaches said second positon, subsequent release of said operating member by said operating member latch means causing said operating member to move from said first position to said second position corresponding to the switch closed position, subsequent release of said carriage by said carriage latch means causing said carriage to move from said second position to said first position, said moving means comprising means carried by said carriage for engaging and acting against said operating member, said moving means further comprising means carried by said operating member for engagement by said carriage-engaging means, said operating-member engagement means comprising a widened portion of said operating member, said carriage comprising a hollow portion with defined walls, a portion of said operating member being disposed within said hollow portion, said carriage engaging means comprising a section of reduced cross-sectional opening with respect to said hollow portion.

2. The operating mechanism of claim 1 wherein said opening spring and said closing spring are compression springs.

3. The operating mechanism of claim 1 wherein said operating member latchs means acts directly between said housing and said operating member.

4. The operating mechanism of claim 1 further comprising a second closing spring disposed about said operating member and within said closing spring.

5. The operating mechanism of claim 4 further comprising a second opening spring disposed concentrically with said opening spring.

6. The operating mechanism of claim 1 wherein said operating member comprises an elongated member having a second widened portion, said second widened portion including apertures for passage of portions of said carriage.

7. The operating mechanism of claim 6 wherein said carriage receives a force input at said portion of said carriage which passes through said second widened portion.

8. The operating mechanism of claim 6 wherein said operating member latch means comprises a first latch receiver carried by said second widened portion of said operating member and a first latch member for insertion into said first latch receiver, said first latch member being disposed at a predetermined location along said housing for alignment with said first latch receiver when said operating member is in said first position.

9. The operating mechanism of claim 8 wherein said carriage latch means comprises a second latch receiver carried by said carriage and a second latch member for insertion into said second latch receiver, said second latch member being disposed at a predetermined location along said housing for alignment with said second latch receiver when said carriage is in said second position.

10. The operating mechanism of claim 9 wherein said first and second latch receivers are rings having a gap therein and said first and second latch members cooperate with said gaps in said rings.

11. The operating mechanism of claim 10 wherein said first and second latch members are slidably mounted for movement generally perpendicular to said path of said carriage and said switch operating member, the planes of said rings being disposed generally perpendicular to said paths.

12. The operating mechanism of claim 10 wherein the ends of the rings forming the gap are heat-treated to provide hardened tip ends.

13. The operating mechanism of claim 11 further comprising means for pivotally mounting said first and second latch members with respect to the planes of said rings.

14. The operating mechanism of claim 13 wherein said pivotal mounting means comprises means for biasing said first latch member in said switch-closing direction and means for biasing said second latch member in the direction of carriage path movement from said second to said first position.

15. The operating mechanism of claim 10 further comprising means for controlling the orientation of said carriage ring with respect to said carriage and for controlling the orientation of said operating member ring with respect to said operating member.

16. The operating mechanism of claim 15 wherein said orientation controlling means comprises a receiving notch formed in each of said rings and an element carried by each of said carriage and operating member arranged to interfit with said receiving notch.

17. The operating mechanism of claim 10 wherein the ends of said rings include an inclined, beveled face defined by a plane perpendicular to the plane of the ring and forming a defined angle with respect to the cross section of the ring.

18. The operating mechanism of claim 10 wherein each of said rings has a substantially circular cross section.

19. The operating mechanism of claim 10 wherein each of said carriage and operating member include a receiving channel for carrying one of said respective rings.

20. The operating mechanism of claim 10 further comprising strengthening means carried by each of said carriage and said operating member at the location where said rings act against said respective carriage and operating member when latched for preventing reaction force from said rings being applied directly to said carriage and said operating member.

21. The operating mechanism of claim 10 further comprising ring-diameter-control means for defining predetermined cross-sectional control surface characteristics in the vicinity of each of said predetermined latch locations to control the diameter of said respective rings.

22. The operating mechanism of claim 21 wherein said ring diameter control means comprises a housing ring carried by said housing, one of said housing rings being disposed in the vicinity of each of said latch locations, said housing rings having predetermined diameter versus height characteristics to allow expansion of said rings within a first range along said respective path of movement and compression of said rings within a second range along said respective path when said respective latch member is not received within said gap of said respective ring.

23. The operating mechanism of claim 22 wherein each of said housing rings includes a tapered surface between said first and second ranges.

24. The operating mechanism of claim 10 further comprising means for normally compressing said rings, said compressing means comprising means defining the cross section of said housing within which said carriage and said operating member are disposed.

25. The operating mechanism of claim 24 wherein said operating member latch means further comprises means for allowing said operating member ring to expand when said operating member ring is in the vicinity of said operating latch member, said carriage latch means further comprising means for allowing said carriage ring to expand when said carriage ring is in the vicinity of said carriage latch member.

26. The operating mechanism of claim 25 further comprising first latch member control means for positioning said first latch member to a latching position and second latch member control means for positioning said second latch member to a latching position before said respective ring is moved to said respective latch location, said latch members in said latching position extending into the area occupied by said ring when said ring is at the latch location.

27. The operating mechanism of claim 26 wherein said first latch member control means further comprises means for withdrawing said first latch member from said gap in said first ring to release said operating member and means for withdrawing said second latch member from said gap in said second ring to release said carriage.

28. The operating mechanism of claim 1 further comprising means for controlling the orientation of said carriage and said operating member with respect to said respective carriage latch means and operating latch means, said orientation being respectively defined at a predetermined angular position with respect to said linear paths.

29. The operating mechanism of claim 28 wherein said orientation controlling means comprises first structural means carried by said carriage and said operating and second structural means carried by said housing for interfitting with said first structural means.

30. The operating mechanism of claim 29 wherein said first structural means comprises an element fixed to said carriage and protruding therefrom and an element fixed to said operating member and protruding therefrom.

31. The operating mechanism of claim 30 wherein said second structural means comrpises a guide aperture formed in said housing parallel to said linear paths.

32. The operating mechanism of claim 1 wherein said carriage path and said operating member path lie along the same axis, said opening spring beng disposed about said axis.

33. The operating mechanism of claim 32 wherein said opening spring and said closing spring are aligned along said axis.

34. The operating mechanism of claim 32 wherein said opening spring is disposed about said closing spring.

35. The operating mechanism of claim 34 wherein said housing includes one or more protuberances against which one end of said opening spring acts.

36. The linear operating mechanism of claim 1 further comprising means connected to said operating member for latching said operating member against movement in a switch-opening direction defined by movement from said second position to said first position.

37. The linear operating mechanism of claim 36 further comprising linkage means connected to said latching means and being driven by said operating member for driving one or more switch operating members at one or more respective outputs, said linkage means being latched against movement corresponding to movement of said operating member in the switch opening direction.

38. The linear operating mechanism of claim 37 wherein said latching means comprises a toggle lever arranged in an over-center condition when said operating member is moved in the switch-closing direction from said first position to said second position.

39. The linear operating mechanism of claim 38 wherein said operating member is connected at a first end of said toggle lever, said linkage means being connected at a second end of said toggle lever, said toggle lever being pivotally mounted intermediate said first and second ends.

40. A linear operating mechanism for an electrical switch, the operating mechanism being capable of immediately reopening the switch after its closure, the operating mechanism comprising:

a housing;

a carriage movable along a linear path between first and second positions;

an operating member to effect opening and closing of a switch and being movable between first and second positions along a path coincident with the path of said carriage;

a closing spring disposed about said operating member, said closing spring acting between said carriage and said operating member;

an opening spring disposed about an axis parallel to or coincident with said closing spring and coincident with the path of said carriage, said opening spring acting between said housing and said carriage;

operating member latch means for selectively latching said operating member against movement in a switch-closing direction;

carriage latch means for selectively latching said carriage in said second position; and means responsive to movement of said carriage from said second position to said first position for moving said operating member from said second position to said first position, said carriage being moved from said first position to said second position to charge said opening spring and said closing spring with operating energy while said operating member is latched by said operating member latch means in said first position corresponding to the switch-open position, said carriage being latched by said carriage latch means when said carriage reaches said second position, subsequent release of said operating member by said operating member latch means causing said operating member to move from said first position to said second position corresponding to the switch closed position, subsequent release of said carriage by said carriage latch means causing said carriage to move from said second position to said first position, said carriage and said operating member being arranged to interfit, said operating member comprising an elongated member and a base portion, said carriage comprising a hollow portion with defined walls, said walls of said hollow portion including apertures and said base portion including apertures to provide the interfitting of said carriage and said operating member, said closing spring being disposed within said hollow portion.

41. The operating mechanism of claim 40 wherein said hollow portion is generally cylindrically shaped.

42. The operating mechanism of claim 40 wherein said hollow portion extends through said base portion of said operating member.

43. The operating mechanism of claim 42 wherein said operating member latch means comprises a latch receiver carried by said base portion.

44. The operating mechanism of claim 43 wherein said latch receiver is a gapped ring, said latch means further comprising a latch member adapted to be received by said gapped ring.

45. A linear operating mechanism for an electrical switch, the operating mechanism being capable of immediately reopening the switch after its closure, the operating mechanism comprising:

a generally cylindrical housing;

a carriage comprising a generally cylindrical portion and being movable along a linear path between first and second positions;

an operating member to effect opening and closing of a switch and being movable along a linear path coincident to the path of said carriage, said operating member comprising an elongated member positioned within said carriage, a widened portion extending from said elongated member and a base portion external to said carriage;

a closing spring disposed about a first portion of said elongated member and within said carriage, said closing spring being a compression spring acting between said carriage and said widened portion of said elongated member;

an opening spring disposed about said elongated member, said opening spring being a compression spring acting between said carriage and said housing;

first selectively releasable latch means acting on said base portion for preventing movement of said operating member in a switch-closing direction;

second selectively releasable latch means for preventing movement of said carriage;

movement of said carriage from said first position to said second position charging said opening and closing springs with operating energy while said operating member is latched, said operating member when released by said first latch means moving in a swith-closing direction, said carriage when subsequently released moving from said second position to said first position and acting against said widened portion of said operating member to move said operating member in a switch-opening direction.

46. A linear operating mechanism for an electrical switch, the operating mechanism being capable of immediately reopening the switch after its closing, the operating mechanism comprising:

a housing;

a carriage movable along a linear path between first and second positions;

an operating member to effect opening and closing of a switch and being movable along a path coincident with the path of said carriage;

a closing spring acting between said carriage and said operating member;

an opening spring disposed about an axis coincident with said closing spring and acting between said housing and said carriage, said opening spring and said closing spring being disposed one inside the other;

operating member latch means for selectively latching said operating member against movement in a switch-closing direction;

carriage latch means for selectively latching said carriage in said second position against movement toward said first position; and means responsive to movement of said carriage from said second position to said first position for moving said operating member in a switch-opening direction, said opening spring and said closing spring being charged with operating energy when said carriage is moved from said first position to said second position.

47. The linear operating mechanism of claim 46 wherein said moving means comprises a portion of said carriage acting against a portion of said operating member.

48. The linear operating mechanism of claim 46 wherein the direction of movement of each of said carriage and operating member is in the same sense when said operating member is moved in the switch-opening direction.

49. The linear operating mechanism of claim 46 wherein said moving means comprises said operating member including a first widened end portion and said carriage includes an aperture through which said operating member is disposed, said aperture being smaller than said first widened portion of said operating member.

50. The linear operating mechanism of claim 49 wherein said housing comprises a side wall and means for defining a narrowed cross section of said housing along said side wall, said opening spring acting against said housing at the point of defined narrowed cross section.

51. The linear operating mechanism of claim 49 wherein said operating member includes a second widened portion, said closing spring acting against said second widened portion.

52. The linear operating mechanism of claim 46 further comprising one or more additional closing springs being concentrically disposed one inside the other.

53. A linear operating mechanism for an electrical switch, the operating mechanism being capable of immediately reopening the switch after its closure, the operating mechanism comprising:

a housing;

a carriage movable along a linear path between first and second positions;

an operating member to effect opening and closing of a switch and being movable between first and second positions along a path parallel to or coincident with the path of said carriage;

a closing spring disposed about said operating member, said closing spring acting between said carriage and said operating member;

an opening spring disposed about an axis parallel to or coincident with said closing spring and acting between said housing and said carriage;

operating member latch means for selectively latching said operating member against movement in a switch-closing direction;

carriage latch means for selectively latching said carriage in said second position; and means responsive to movement of said carriage from said second position to said first position for moving said operating member from said second position to said first position, said carriage being moved from said first position to said second position to charge said opening spring and said closing spring with operating energy while said operating member is latched by said operating member latch means in said first position corresponding to the switch-open position, said carriage being latched by said carriage latch means when said carriage reaches said second positon, subsequent release of said operating member by said operating member latch means causing said operating member to move from said first position to said second position corresponding to the switch closed position, subsequent release of said carriage by said carriage latch means causing said carriage to move from said second position to said first position, said operating member latch means comprising a first latch member for insertion into said first latch receiver, said first latch member being disposed at a predetermined location along said housing for alignment with said first latch receiver when said operating member is in said first position, said carriage latch means comprising a second latch receiver carried by said carriage and a second latch member for insertion into said second latch receiver, said second latch member being disposed at a predetermined location along said housing for alignment with said second latch receiver when said carriage is in said second position, each of said first and second latch receivers comprising a ring having a gap therein, each of said first and second latch members cooperating with said respective gap in said respective ring, each of said carriage latch means and said operating member latch means further comprising means for slidably mounting said respective latch member for movement generally perpendicular to said path of said carriage and said switch operating member, the planes of said rings being disposed generally perpendicular to said paths, each of said carriage latch means and said operating member latch means further comprising means for pivotally mounting said respective latch member with respect to the planes of said rings.

54. The operating mechanism of claim 53 wherein said pivotal mounting means of said operating member latch means comprises means for biasing said first latch member in said switch-closing direction and said pivotal mounting means of said carriage latch means comprises means for biasing said second latch member in the direction of carriage path movement from said second to said first position.

55. A linear operating mechanism for an electrical switch, the operating mechanism being capable of immediately reopening the switch after its closure, the operating mechanism comprising:

a housing;

a carriage movable along a linear path between first and second positions;

an operating member to effect opening and closing of a switch and being movable between first and second positions along a path parallel to or coincident with the path of said carriage;

a closing spring disposed about said operating member, said closing spring acting between said carriage and said operating member;

an opening spring disposed about an axis parallel to or coincident with said closing spring and acting between said housing and said carriage;

operating member latch means for selectively latching said operating member against movement in a switch-closing direction;

carriage latch means for selectively latching said carriage in said second position; and means responsive to movement of said carriage from said second position to said first position for moving said operating member from said second position to said first position, said carriage being moved from said first position to said second position to charge said opening spring and said closing spring with operating energy while said operating member is latched by said operating member latch means in said first position corresponding to the switch-open position, said carriage being latched by said carriage latch means when said carriage reaches said second position, subsequent release of said operating member by said operating member latch means causing said operating member to move from said first position to said second position corresponding to the switch closed position, subsequent release of said carriage by said carriage latch means causing said carriage to move from said second position to said first position, said operating member latch means comprising a first latch receiver carried by said operating member and a first latch member for insertion into said first latch receiver, said first latch member being disposed at a predetermined location along said housing for alignment with said first latch receiver when said operating member is in said first position, said carriage latch means comprising a second latch receiver carried by said carriage and a second latch member for insertion into said second latch receiver, said second latch member being disposed at a predetermined location along said housing for alignment with said second latch receiver when said carriage is in said second position, each of said first and second latch receivers comprising a ring having a gap therein, each of said first and second latch members cooperating with said respective gap in said respective ring, the linear operating mechanism further comprising means for controlling the orientation of said carriage ring with respect to said carriage and for controlling the orientation of said operating member ring with respect to said operating member, said orientation controlling means comprising a receiving notch formed in each of said rings and an element carried by each of said carriage and said operating member, each of said elements being arranged to interfit with said respective receiving notch.

56. A linear operating mechanism for an electrical switch, the operating mechanism being capable of immediately reopening the switch after its closure, the operating mechanism comprising:

a housing;

a carriage movable along a linear path between first and second positions;

an operating member to effect opening and closing of a switch and being movable between first and second positions along a path parallel to or coincident with the path of said carriage;

a closing spring disposed about said operating member, said closing spring acting between said carriage and said operating member;

an opening spring disposed about an axis parallel to or coincident with said closing spring and acting between said housing and said carriage;

operating member latch means for selectively latching said operating member against movement in a switch-closing direction;

carriage latch means for selectively latching said carriage in said second position;

means responsive to movement of said carriage from said second position to said first position for moving said operating member from said second position to said first position, said carriage being moved from said first position to said second position to charge said opening spring and said closing spring with operating energy while said operating member is latched by said operating member latch means in said first position corresponding to the switch-open position, said carriage being latched by said carriage latch means when said carriage reaches said second position, subsequent release of said operating member by said operating member latch means causing said operating member to move from said first position to said second position corresponding to the switch closed position, subsequent release of said carriage by said carriage latch means causing said carriage to move from said second position to said first position; and means for controlling the orientation of said carriage with respect to said carriage latch means and for controlling the orientation of said operating member with respect to said operating member latch means, said orientation being respectively defined at a predetermined angular position with respect to said linear path, said orientation controlling means comprising a first element fixed to said carriage and protruding therefrom, a second element fixed to said operating member and protruding therefrom, and a guide aperture formed in said housing parallel to said linear paths, said first and second elements protruding through said guide aperture.

* * * * *

UNITED STATES PATENT AND TRADEMARK OFFICE

CERTIFICATE OF CORRECTION

PATENT NO. : 4,636,602

DATED : January 13, 1987

INVENTOR(S) : Walter J. Hall, et al

It is certified that error appears in the above-identified patent and that said Letters Patent is hereby corrected as shown below: Title page:

In the Abstract, line 11, "springs" should be -- spring --;
Col. 1, lines 9 and 19, and Col. 2, line 32, "commonly-assigned" should be -- commonly assigned -- (delete hyphen)
Col. 9, line 16, "accomodations" should be -- accommodations --;
lines 15 and 16, "necessiate" should be -- necessitate --;
line 43, "sleeeve" should be -- sleeve --;
line 68, "relase" should be -- release --;
Col. 10, line 44, col. 11, line 38, and col. 11, line 61, "Similarily" should be -- Similarly --;
Col. 15, line 26, delete "," (comma);

Col. 15, claim 1, line 51, after "closure" insert -- , -- (comma);
Col. 16, claim 1, line 14, "positon" should be -- position --;
Col. 16, claim 3, line 39, "latchs" should be -- latch --;
Col. 17, claim 19, line 46, "include" should be -- includes --;
Col. 18, claim 29, line 47, after "operating" insert -- member --.

Signed and Sealed this

Sixth Day of September, 1988

*Attest:*

DONALD J. QUIGG

*Attesting Officer*

*Commissioner of Patents and Trademarks*